United States Patent [19]

Powell

[11] Patent Number: 4,662,760

[45] Date of Patent: May 5, 1987

[54] PNEUMATIC PAINT SHAKER

[75] Inventor: Patrick W. Powell, Castle Rock, Colo.

[73] Assignee: Broncorp Manufacturing Company, Inc., Lakewood, Colo.

[21] Appl. No.: 683,064

[22] Filed: Dec. 18, 1984

[51] Int. Cl.[4] ..... B01F 11/00

[52] U.S. Cl. ..... 366/211; 91/299; 366/605

[58] Field of Search ..... 366/605, 210, 211, 232, 366/237, 209; 91/290, 299, 317, 319

[56] References Cited

U.S. PATENT DOCUMENTS

| | | | |
|---|---|---|---|
| 1,418,333 | 6/1922 | Smith | 91/290 |
| 1,711,811 | 5/1929 | Rudlin | 91/290 |
| 2,599,833 | 6/1952 | Holmlund | 366/605 |
| 3,187,638 | 6/1965 | Talbutt | 91/290 |
| 3,207,043 | 9/1965 | Kay | 91/290 |

*Primary Examiner*—Robert W. Jenkins
*Attorney, Agent, or Firm*—Ralph F. Crandell

[57] ABSTRACT

A painter shaker having a base housing with a double acting pneumatic piston and cylinder motor horizontally mounted within said housing. The motor includes a cylinder and a reciprocable piston in the cylinder having a piston rod slidably and sealably extending through one end wall of said cylinder. A clamp mechanism for holding a container to be shaken is secured to a vertical shaft rotatably mounted on said housing for oscillation about a vertical axis. A crank arm connects the vertical shaft to the piston rod. A disc type bistable control valve is mounted transversely directly on the lower side of the air cylinder. The bistable valve includes outlet ports communicating with inlet ports on the cylinder at the rod end and compressed air is supplied to said valve through a check valve, the control disc controlling the flow of air to the outlet ports.

28 Claims, 15 Drawing Figures

PNEUMATIC PAINT SHAKER

BACKGROUND OF THE INVENTION

1. Field of the Invention

This invention relates to improvements in a compressed air powered paint shaking machine, and to a compressed gas powered mechanism for imparting a linear or rotational quasi-sinusoidal vibration or oscillatory motion to various loads.

2. Description Of The Prior Art

Prior pneumatically driven paint shaking machines have typically been powered by single-acting air cylinder motors, and have relied on coil springs for reversing the motion imparted by the motor piston. See, for example, U.S. Pat. No. 3,301,534, issued Jan. 31, 1976, to L. D. Orser for "Paint Shaker Machine". Valving for this type of machine has been either a simple piston-actuated poppet air admission valve with exhaust ports in the cylinder wall, or a link-operated variation of the ancient steam chest slide valve. In either case, the machine was limited as to power, speed, efficiency and reliability. Because the return springs were linear, a compromise had to be accepted between the need for a stiff spring to provide high speed and powerful shaking action, and the need for a soft spring to promote ease of starting. Further, a stiff spring in turn required a more powerful air cylinder motor, making starting very difficult in the case of a poppet valve type, and making for unacceptably high air consumption or difficult starting with the slide type valve, owing to inherent valve timing limitations. When operated at recommended supply pressures, such shakers will not adequately and quickly shake a large can of paint, and when operated under overpressure conditions, these shakers are unable to control their motions without collisions of internal parts which leads to damage and a shortened machine life.

Modern metallic paints contain powdered aluminum which settles to the bottom of the paint container during storage and forms a heavy cake or sludge on the bottom of the container. It is difficult to re-suspend completely the metallic particles without a highly energetic shaking motion. Prior pneumatic shakers have not performed adequately as metallic paint mixers. The powerful electric motor-powered shakers which have performed adequately have been heavy, bulky, and expensive.

An associated problem with prior machines was that the valving arrangements used were not suitable for higher speed operations. Poppet valve controlled machines seemed to promise high efficiency at high speed because their compression stroke provided a pneumatic spring effect and incidentally precompressed the air in the cylinder to a pressure just below that of the compressed air supply under design conditions. This resulted in low flow losses upon gas admittance and expansion was nearly adiabatic. All this promised good efficiency, which was obtained, but only in a narrow operating range. Starting the machine required manually precompressing the cylinder until the piston contacted the poppet valve to admit compressed air, and higher compression ratio or larger diameter cylinders made starting difficult and potentially more dangerous. It would have been necessary to increase compression ratio or cylinder size in order to increase the speed and power of the machine. The machines with linkage operated valves had somewhat more design flexibility but the valve timing and design changes which would promote easier starting of larger cylinders would also reduce efficiency and maximum speed. Since compressed air system efficiency is, at best, not very high owing to thermodynamic losses in compression as well as expansion, and energy costs are becoming significant, large efficiency reductions can have a serious impact on the market value of the air-powered machine. Also, rough mathematical models of mixing ability in paint shakers show that mixing power is, in the microscale, dependent on the frequency of oscillation times the maximum liquid shear rate. This means that microscale mixing is roughly proportional to the third power of the speed of a given fixed-amplitude machine, making speed very important to mixing performance. A high speed, high efficiency, easy starting valving arrangement was needed.

OBJECT AND SUMMARY OF THE INVENTION

It is the principal object of the present invention to provide an improved pneumatic or compressed air motor finding particular but necessarily exclusive utility for imparting a linear or rotational quasi-sinusoidal motion to various loads such as a paint shaking machine.

Another object of this invention is to provide an improved paint shaking apparatus embodying an air powered motor of the foregoing character.

A further object of the present invention is to provide a compressed gas powered mechanism which is durable, reliable, efficient, easy to start and abuse tolerant.

Still another object of the present invention is to provide a paint shaking mechanism which is highly energetic, powerful, of minimum bulk and relatively inexpensive.

Still a further object of the present invention is to provide a paint shaker mechanism of the foregoing character which is suitable for use in explosive atmospheres.

Still a further object of the present invention is to provide a paint shaker of the foregoing characters which will adequately and quickly shake a large can of paint, and when operated under over-pressure conditions, will control its motion without collision of internal parts and is thereby rugged, reliable and efficient.

Other objects and advantages of the present invention will be apparent from the following description of the present invention.

In accordance with the foregoing objects, the present invention, as shown in the accompanying drawings, is embodied in a paint shaker utilizing a pneumatic or compressed gas powered motor mechanism. The paint shaker is formed by a housing mounting a vertical main shaft which supports a container clamp assembly at one end and is engaged through a simple crank arm at its other end to a double acting air cylinder motor. The double acting air cylinder motor is controlled by a differential pressure actuated bistable valve assembly and check valve in a compressed air line between a compressed air supply and the motor.

The can clamp frame assembly is formed by angularly related guides which slidingly support can clamp jaws. The jaws slide on the guides and are moved together or apart by a clamping screw mechanism. The clamp's screw is housed within the guide to protect it from dust, damage and paint spills.

The air cylinder motor is secured between the crank arm and the housing by an appropriate shock mount assembly. The motor includes a cylinder with an internally housed piston. Compressed air is supplied alternately to opposite sides of the piston by a bistable disc valve which responds to a difference in pressure between the cylinder ends. A central exhaust port in the cylinder wall is alternately opened to one or the other of the cylinder ends as the piston moves laterally within the cylinder. The bistable disc valve and check valve thus provide compressed air alternately to each end of the cylinder and thereby effect a reciprocation of the piston in the cylinder. The piston is connected by the crank arm to the shaft and thereby oscillates the can clamp mechanism and a can clamped therein.

In a modified form, the apparatus involves a countermass in the form of a counterwheel forming the housing and dust shield for the machine. The counterwheel is supported by appropriate bearings on the main shaft and anchors the cylinder motor assembly, which in turn is connected to the main shaft by the crank arm. A centering spring locates the counter wheel in an average orientation with respect to a base on which the unit is supported.

DESCRIPTION OF THE PREFERRED EMBODIMENT

Figure 1:
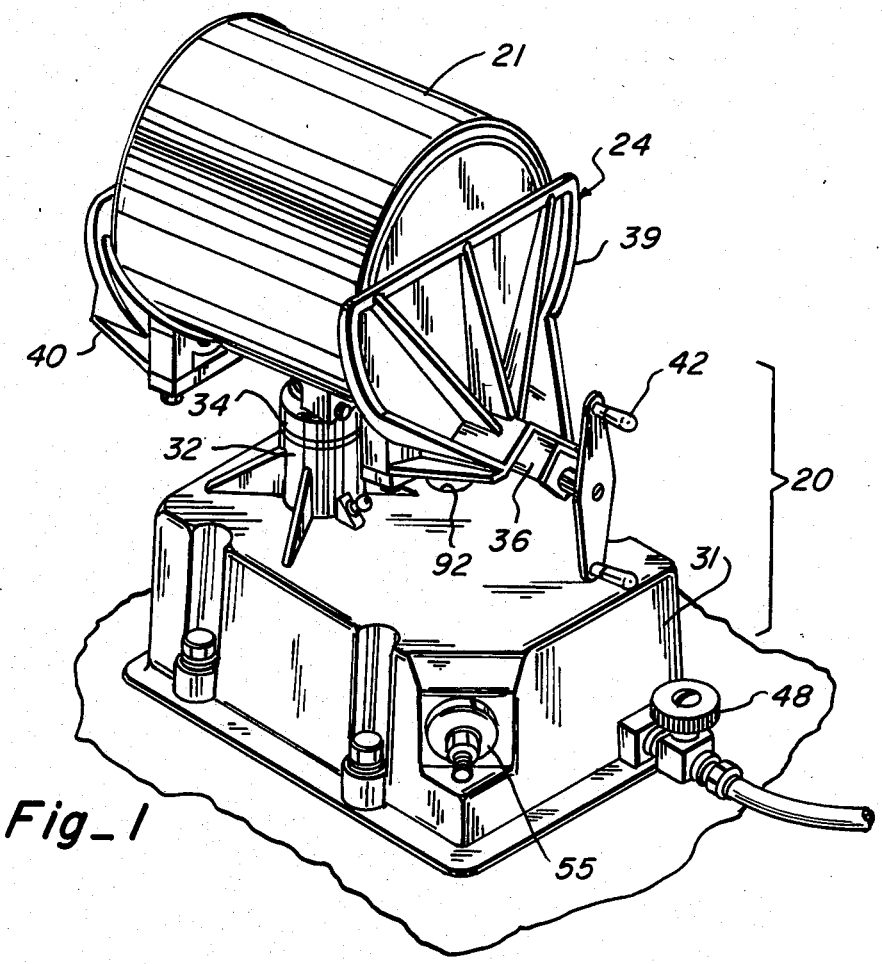
FIG. 1 is a perspective view of a paint shaker embodying the present invention.

The present invention is embodied in a paint shaker 20 providing a simple, torsional, oscillatory motion on an axis through the transverse centerline of a container 21 being shaken. The machine includes a vertical main shaft 22 which supports a container clamp assembly 24, and is engaged with and driven by a simple crank arm 25. A double-acting air cylinder motor 26 drives the crank arm 25 and oscillates the shaft 22 and thus the clamp assembly 24 carried thereby.

The double-acting air cylinder motor 26 is controlled by a differential pressure-actuated, bistable valve 28 mounted on one side of the cylinder 26 to provide for short connecting passageways between the valve and the motor. The combination of the valve mounting arrangement, valve design features, and cylinder design enables the double acting air cyllinder to function as an efficient, powerful, non-linear pneumatic spring as well as a very efficient pneumatic motor.

Figure 2:
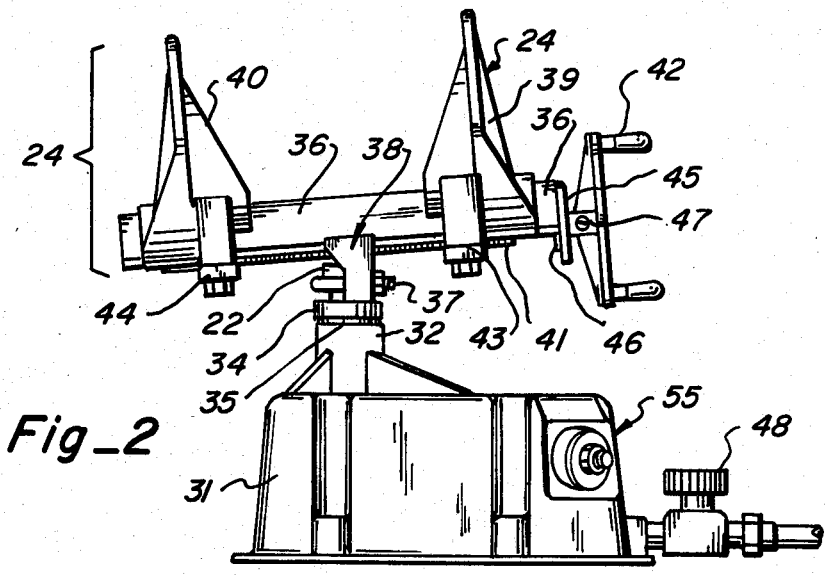
FIG. 2 is a side elevational view of the paint shaker shown in FIG. 1.
Figure 3:
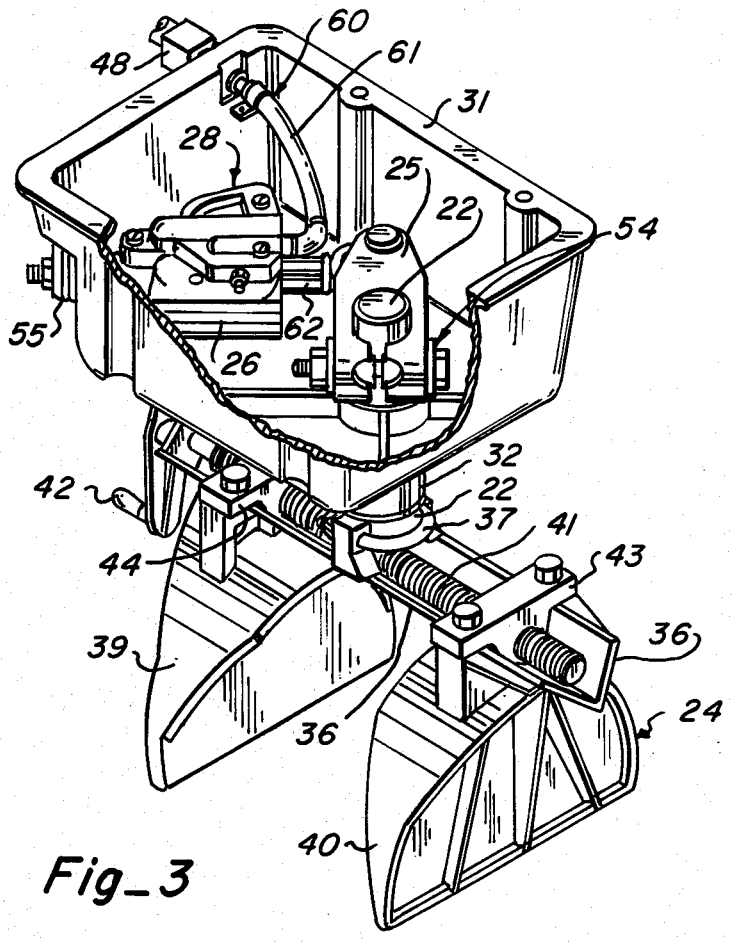
FIG. 3 is a perspective view of the paint shaker shown in FIG. 1, with the shaker upside down and a portion of the housing cut away.
Figure 4:
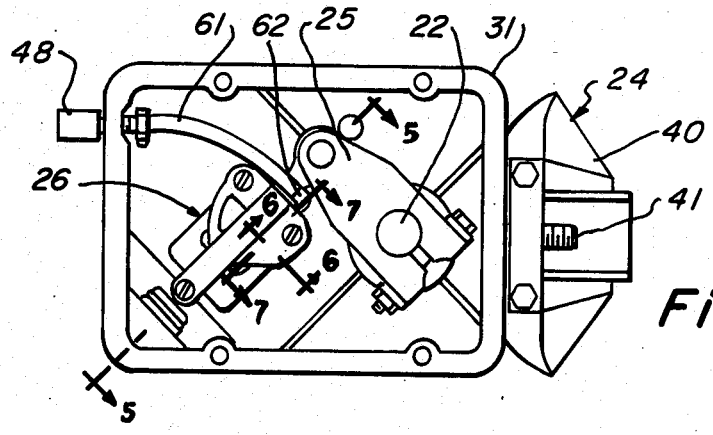
FIG. 4 is a bottom view of the machine shown in FIG. 1, showing the motive parts.

Referring to FIGS. 1, 2, and 3, a base housing 31 defines a main shaft supporting boss 32 containing bearings, (not shown) which rotatably support the main shaft 22. The main shaft 22 is located axially vertically by a shaft collar 34 annd main thrust bearing 35. The can clamp assembly 24 is secured to the main shaft 22 by a U-bolt 37 which clamps the clamp frame assembly 38 firmly to the shaft 22, but allows the user to orient the clamp frame assembly in any preferred direction by simply loosening the U-bolt 37. The clamp frame assembly 38 defines upper, angularly related guide surfaces 36 which slidingly support and guide the can clamp jaws 39 and 40, and also axially locate and protect a clamp screw 41. The clamp screw 41 is machined with right and left hand threads which respectively engage left and right hand thread guide nuts 43 and 44 bolted respectively to the bottoms of the jaws 39 and 40. The guide surfaces 36 conform to corresponding guide surfaces on the underside of the channel or angle frame portion of the jaws 39 and 40 of the clamp frame assembly 38 in such a way that the jaws 39 and 40 may be positioned laterally and rotationally rigidly but are axially slidable along the clamp frame assembly 38. The axially sliding jaw motion is regulated by the threaded engagement of the nuts 43 and 44 with the clamping screw 41, and the clamping screw is in turn axially restrained by a clamp screw retaining ring 45, and thrust washer 46. A crank 42 is rigidly secured on said clamp screw by a roll pin 47. The operator twirls the handle 42 to move the jaws 39 and 40 symmetrically but oppositely about the main shaft centerline, and thereby clamp a can or container 21 to be shaken between both jaws 39, 40. The can is thus clamped with its center of gravity roughly coincident with the axis of the main shaft 22.

The can clamp assembly protects the clamp screw 41 from dust, paint spills, dirt and mechanical damage, while providing a simple, easily cleaned and lubricated, low inertia, easily operable and functionally sturdy can holding device. Further, the clamp is resistant to loosening during shaking, even when insufficiently tightened, owing to the wedging effect of the jaws upon the clamp frame assembly, and if operated when loose, it emits a clearly audible rattling noise long before loosening sufficiently to allow the can to open up or be ejected from the clamp, giving the operator a clear and early warning of the needed corrective action.

Having changed or inserted a container 21 to be shaken in the machine, the operator opens a control valve 48 to regulate the shaking speed of the air cylinder motor 26 as desired. The air cylinder-motor assembly 26 operates reciprocally, the piston 49 (FIG. 5) and rod 50 moving the outer end of the crank arm 25 back and forth through a short arc by means of a rod end bearing assembly 51, pin 52, and retainers 53. The crank arm 25, being clamped rigidly to the main shaft 22 by means of a crank arm bolt, nut, and bushing assembly 54, rotates the main shaft 22 and hence the can clamp assembly 24 in a torsionally oscillatory motion. The circular oscillatory motion of the rod end of the crank arm 22 requires that the cylinder motor assembly be able to tilt slightly about its point of attachment to the housing 31. This motion is accommodated by an elastomeric shock mount assembly 55, consisting of a mounting stud 56, a steel thrust washer 57, and an elastomeric cushion disc 58 on each side of the housing wall through which the cylinder head mounting stud 56 protrudes. The shock mount assembly 55 is pre-loaded and the head end of the cylinder-motor assembly firmly secured by tightening a stud nut 59 on the stud 56.

The combination of the shock mount assembly 55 with the air powered shaker provides numerous advantages. The shock cushions deform under the load of the cylinder thrust to provide the operator with a ready indicator of the load being applied to the machine. Because the rear half of the cushion assembly and stud is designed to protrude through the housing, the load is therefore sensible by sight and touch. At the design maximum load conditions, the peak oscillatory force applied to the shock mount assembly is approximately 900 pounds. This load produces a considerable but tolerable cushion deflection. Overloading produces a visually and tactibly obvious condition of distress at the shock mount, and if prolonged, will damage the cushions, which are inexpensive and readily replaceable. Thus the shock mount performs not only as a load-/overload indicator, but as a mechanical fuse-like sensor, preventing potentially serious damage to the more expensive and less easily replaceable parts of the machine.

Should the piston 49 begin bottoming out in the cylinder 26 due to internal leakage, this condition is readily felt at the cylinder head mounting by the operator, giving a reliable indication that something is seriously wrong with the machine. Rod end bearing failure is also detectible in this manner. When such shocks occur, the shock mount minimizes the shock loading applied to internal parts, reducing any resulting damage. The shock mount assembly requires no lubrication and is considerably less expensive than would be a precision cylinder head bearing and journal pin assembly.

Figure 8:
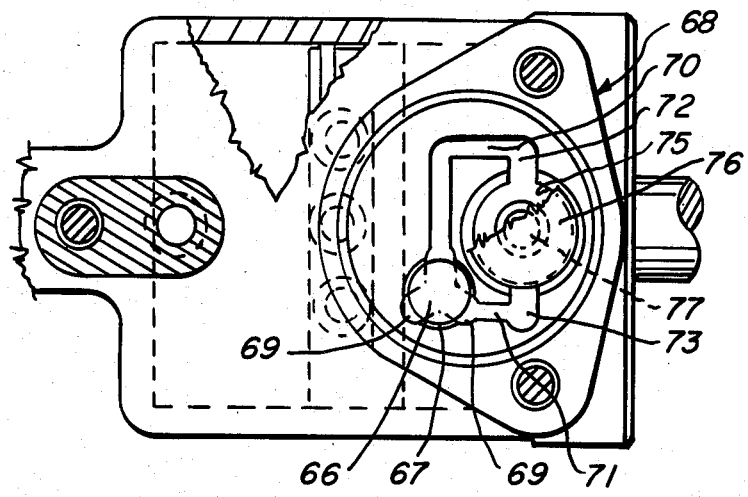
FIG. 8 is a section view taken substantially in plane of line 8—8 on FIG. 5, and showing a bottom view of the inner body half of the valve mechanism.
Figure 9:
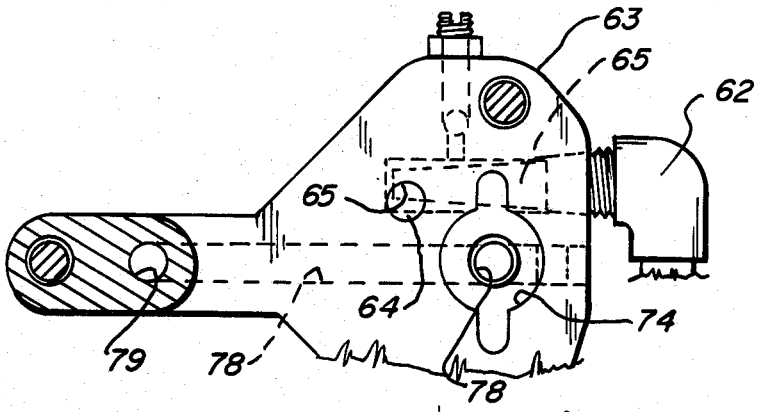
FIG. 9 is a section view taken substantially in the plane of line 9—9 or FIG. 5, and showing a top view of the outer body half of the valve mechanism and related parts.
Figure 10:
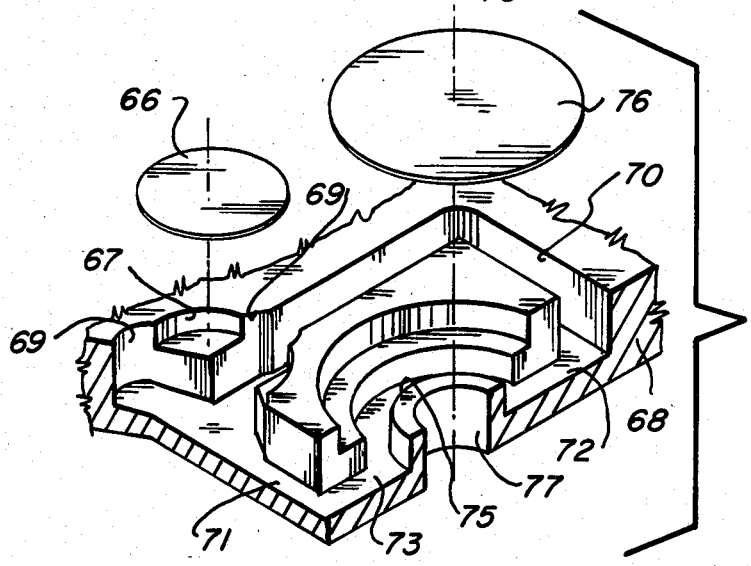
FIG. 10 is a fragmentary bottom perspective view of the inner body half shown in FIG. 8, partly in section and with parts cut away or removed and showing a portion of the control valve and check valve mechanism.

The cylinder-motor assembly 26 receives its compressed air or gas supply from an internal air hose assembly 60 consisting of a short length of flexible, elastomeric or plastic tubing 61, with an appropriate fitting 62 connecting the control valve 48 with the outer valve body 63 of the valve 28, and mounted on the wall of the cylinder 26. Referring to FIGS. 8, 9, and 10, compressed air enters the outer valve body 63 of the valve 28 through an inlet strainer 65, then flows out of the outer valve body 63 through a passage 64, around a check disc 66, and into a check disc cavity 67 of the inner valve body 68. Referring to FIG. 8, air flows from the check disc cavity 67 into check disc bypass slots 69 and thence into air passages 70 and 71 leading to valve cavity supply plenums 72 and 73 and valve cavity air feed annuli 74, 75, one (74) of which is located in the outer valve body 63 and the other (75) in the inner valve body 68 (FIGS. 5, 8–10).

Figures 5, 6, 7:
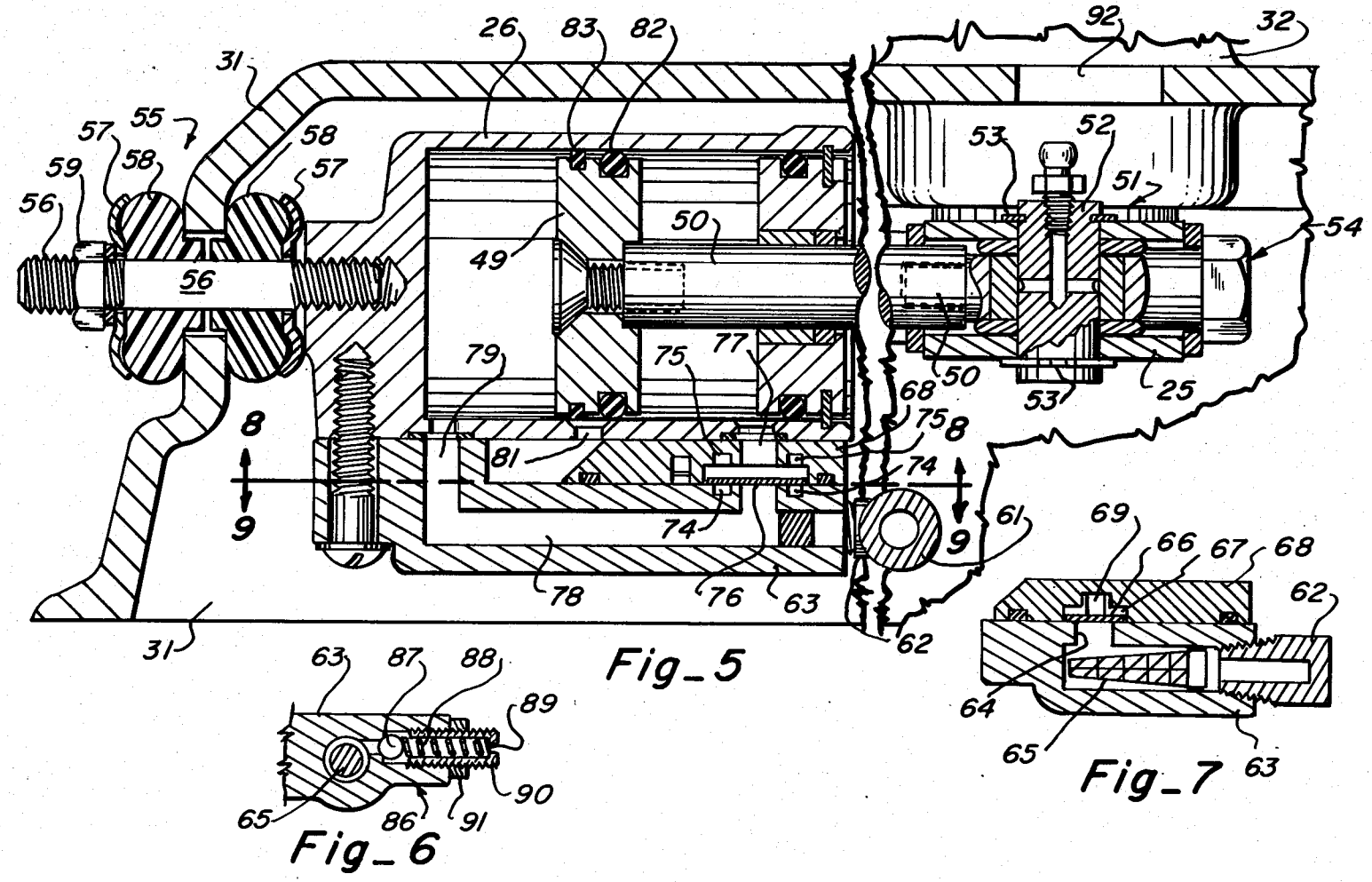
FIG. 5 is an enlarged section view taken substantially in the plane of line 5—5 on FIG. 4.
FIG. 6 is an enlarged section view taken substantially in the plane of line 6—6 on FIG. 4.
FIG. 7 is an enlarged section view taken substantially in the plane of 7—7 on FIG. 4.

From the air feed annuli 74, 75, the compressed air then flows past a valve disc 76 into either a port 77 leading to one end of the cylinder or into a transfer passage 78 leading to a second inlet port 79 in the other end of the cylinder (FIG. 6). It can be seen that if there is any net pressure imbalance from one side of the valve disc 76 to the other, the disc 76 will be rapidly moved away from the higher pressure side to close the lower pressure port, and that the action of closure rapidly tends to increase the pressure difference. The valve disc 76 and associated annular air feed passages 74, 75, form a bistable valve structure. This blistable valve acts bistably to introduce air alternatively to opposite ends of the cylinder 26. This bistability is a key operating feature of this type of valve, which is employed to beneficial effect in this invention.

Because the ports 77 and 79 connect directly and openly with the opposite ends of the cylinder 26, the valve disc 76 responds directly to a difference in pressure between the cylinder ends, supplying air to the higher pressure side of a piston 49 slideably mounted in the cylinder 26. The relative pressure difference between the cylinder ends depends on the position of the piston 49, since the position of the piston controls which cylinder end is open to one or more exhaust ports 81, (FIGS. 5, 11 and 12) which are positioned in the lower cylinder wall near the mid-point of piston travel.

When the operator first opens the control valve 48, the main valve disc 70 functions to supply all of the air to that cylinder end which is relatively most closed to the exhaust ports 81, since that end will rapidly develop the highest relative pressure. Should the piston happen to be over the exhaust ports and blocking the exhaust of air from both cylinder ends equally, the operator need merely open the valve momentarily, close it, and then re-open it again. This action will displace the piston slightly to one side of the exhaust ports. This occurs as a result of inherent differences in the volume of the two cylinder ends, as well as because the exhaust ports 81 are too large to be completely blocked by the piston seal O-ring 82, and the fact that there are inherent differences in the leak resistance of flow past the piston 49 to the exhaust ports 81 caused by the presence of a wear ring 83.

Figure 11:
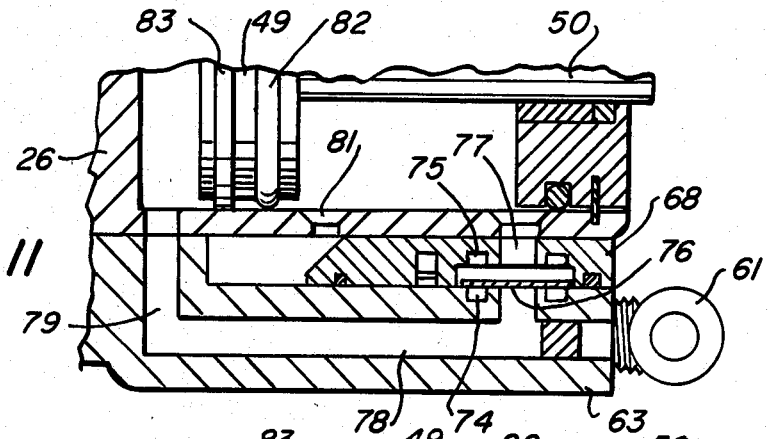
FIG. 11 is a diagramatic cross-section view showing the compressed air path for driving the motor piston in one direction.
Figure 12:
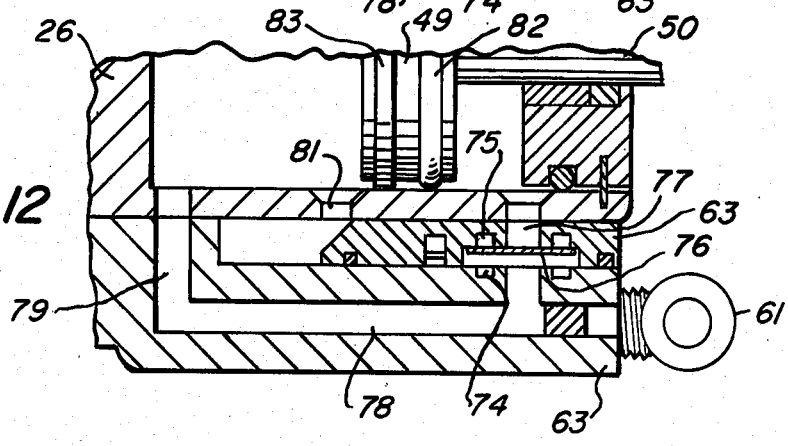
FIG. 12 is a diagramatic cross-section view showing the compressed air path for driving the motor piston in the opposite direction from that shown in FIG. 11.
Figure 13:
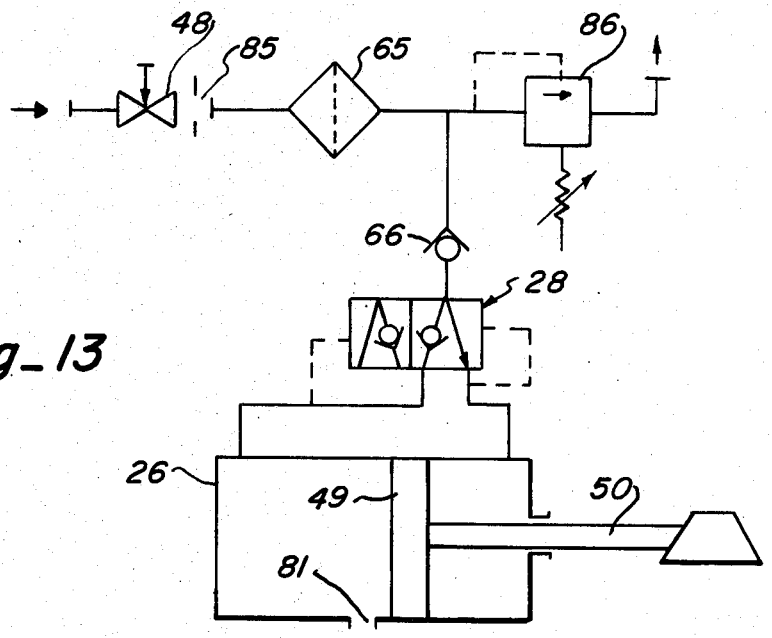
FIG. 13 is a schematic diagram showing the compressed gas flow path for a machine embodying the present invention.

Referring to the schematic diagrams as shown in FIGS. 11, 12 and 13, as soon as the opening of the main valve 48 causes definite piston movement, the piston 80 moves in response to a pressure difference until it crosses the exhaust ports 81, which movement reverses the cylinder pressure differential and switches the valve disc 76. The valve disc 76 diverts supply air to reverse the direction of piston motion. and the process continues, the velocity of the piston rapidly building owing to the application of supply air pressure, the inertia of the load, (including a can mounted on the shaker and the moving parts of the shaker), and further owing to the compressibility of the air in the cylinder ends. As the piston speed and travel rapidly increases, inertial forces substantially exceed the frictional forces. If sufficient air pressure is admitted through the control valve 48, the piston compresses the air in a given cylinder end to a pressure equal to the supply air pressure. This occurs because compression pressure rises exponentially, not linearly, with piston travel, and because a controlled amount of time is required for the air pressure in the opposite end of the cylinder to be exhausted through the exhaust ports 81 to a pressure low enough for the valve disc 76 to switch. Therefore, for a substantial distance after crossing the exhaust ports, the exhausting gas is still propelling the piston and performing work. Only as the piston nears the cylinder end and compression pressure begins to rise rapidly does the valve disc 76 switch.

At the point at which the valve disc switches, sufficient work has been done to cause the inertia of the can and moving parts of the shaker to continue to compress the trapped gas. Except for the check disc 66, the piston would reverse the supply air flow and expel the trapped air back into the supply line. The stroke of the cylinder would have to be made long enough to allow line pressure to gradually slow the piston to a stop and reverse it without permitting the piston to collide with the cylinder head end. Mixing action would be substantially less energetic and machine efficiency would drop substantially owing to flow losses caused by the reverse air pumping. Thus the check disc 66, in combination with the high compression ratio cylinder, may be observed to have a novel, unobvious, and very important function. By preventing reverse flow, the check disc 67 traps the air in the cylinder, air pressure rises exponentially to a multiple of as much as several times line pressure, and the piston is rapidly decelerated, reversed, and accelerated. This rapid acceleration-decleration-acceleration cycle greatly promotes mixing while minimizing the cylinder stroke and diameter required and eliminating essentially all reverse pumping losses. The high net cylinder compression ratio provides a substantial safety factor, such that the machine can be substantially overloaded and/or oversped without incurring a piston collision and without having to enlarge the stroke capacity to prevent such a collision. Thus the check disc 66 increases performance, efficiency, and reliability, while minimizing machine size and cost.

Because there is a practical maximum compression ratio which can be achieved, and there is a danger some users may connect to a source of very high air pressure, an orifice 85 (FIG. 13) and relief valve 86 (FIGS. 6 and 13) are incorporated into the machine to provide an inexpensive means of regulating the maximum supply pressure available to the valve disc 76. The orifice 85 is provided by a restriction orifice in the control valve 48 or the inlet piping downstream, and a ball and spring relief valve 86 is installed in the outer valve body 63 (FIG. 6). When pressure exceeds the relief valve setpoint, inlet strainer cavity pressure acting on relief ball 87 overcomes the relief spring 88 and air is released through the gaps in the coils of the relief spring 88 and then is released through a centerhole 89 in a relief set screw 90. The set screw is locked at the required set point pressure by a jam nut 91. The released air, together with cylinder exhaust air, is muffled by the internal volume of the housing and exits through a vent and lubrication access hole 92 in the housing (FIGS. 1 and 5).

In order to permit the cylinder to develop a maximum net compression ratio, it is necessary to minimize the internal volume of all ports and passages back to the check disc 66, as well as to minimize the residual cylinder volume unswept by the piston. By placing the cylinder inlet ports 78, 79 directly in the cylinder wall, and by placing the valve disc 76 and check disc 66 in closest proximity thereto, the compression ratio may be maximized. The arrangement of the valve bodies, and particularly the inner valve body of this invention, facilitates this goal greatly while controlling manufacturing costs. Also, with a high compression cylinder, there is a danger that entrained condensation and excess lubricating oil, being noncompressible, may cause a hydraulic lockup equivalent to collision of the piston with an end of the cylinder. The arrangement of the valve bodies and the cylinder in the present configuration minimizes the effect of liquids and exhausts them efficiently. The inner valve body 68 places the valve disc 76 and cavities in closest and most direct proximity to the rod end inlet port 77 of the cylinder 26, consistent with a reasonably short head end transfer passage 78 to the inlet port 79. This configuration maximizes the compression ratio at the rod end, compensating for the lower net effective piston area at the rod end, and accommodates the relatively higher damage susceptibility of the machine to rod end side piston collisions. Also, the valve bodies and passages are located directly below the cylinder, and entrained but unsuspended liquids entering the valve body tend to drop into the transfer passage 78 and port 79 instead of being carried up into the rod end inlet port 77. Liquids thus tend to be directed primarily to the head end of the cylinder, at which the passages have extra volume for temporarily storing the liquids when the piston nears the head. The head end side, as noted above, is also more resistant to damage should an intolerable volume of liquids enter the machine. The flow of supply air through the ports 77, 78, tends to clear them, and the liquids tend to be directed by air flow streamlines toward the exhaust ports 81, which drain and collected liquids by being in the bottom of the cylinder. Also, the explusion of liquids into the inlet ports by the piston results in two-phase flow and pumping losses which slow the machine, increasing headspace between the piston and heads, thus increasing liquid capacity and tolerance. Furthermore, the orifice 85 slows air flow into the machine when having to pass liqulds, comprising another important protection feature. The arrangement of the valve bodies further permits manufacturing economies. Except for the passage in which the inlet strainer 65 is located, the head end transfer port 79, and the relief valve passage 89, all cavities, slots, and passages are formed as simple open depressions in a valve body surface, which facilitates manufacture by injection molding or powder fusing, both of which processes are substantially less expensive than machining.

Figure 14:
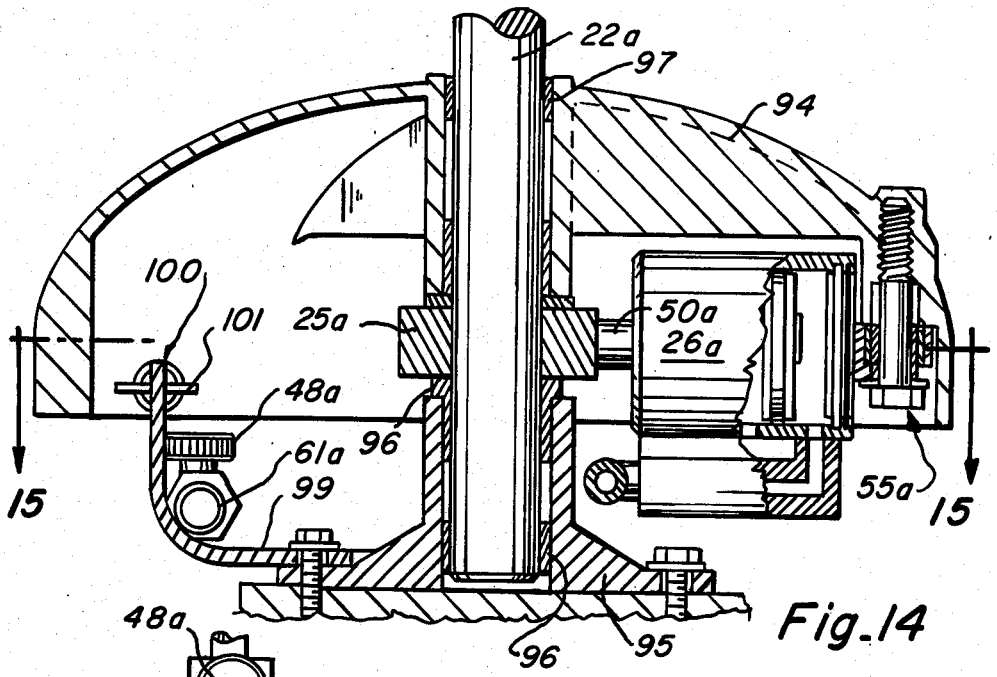
FIG. 14 is a side view with a portion cut away of a modified form of a paint shaker embodying the present invention and including counterweighting.
Figure 15:
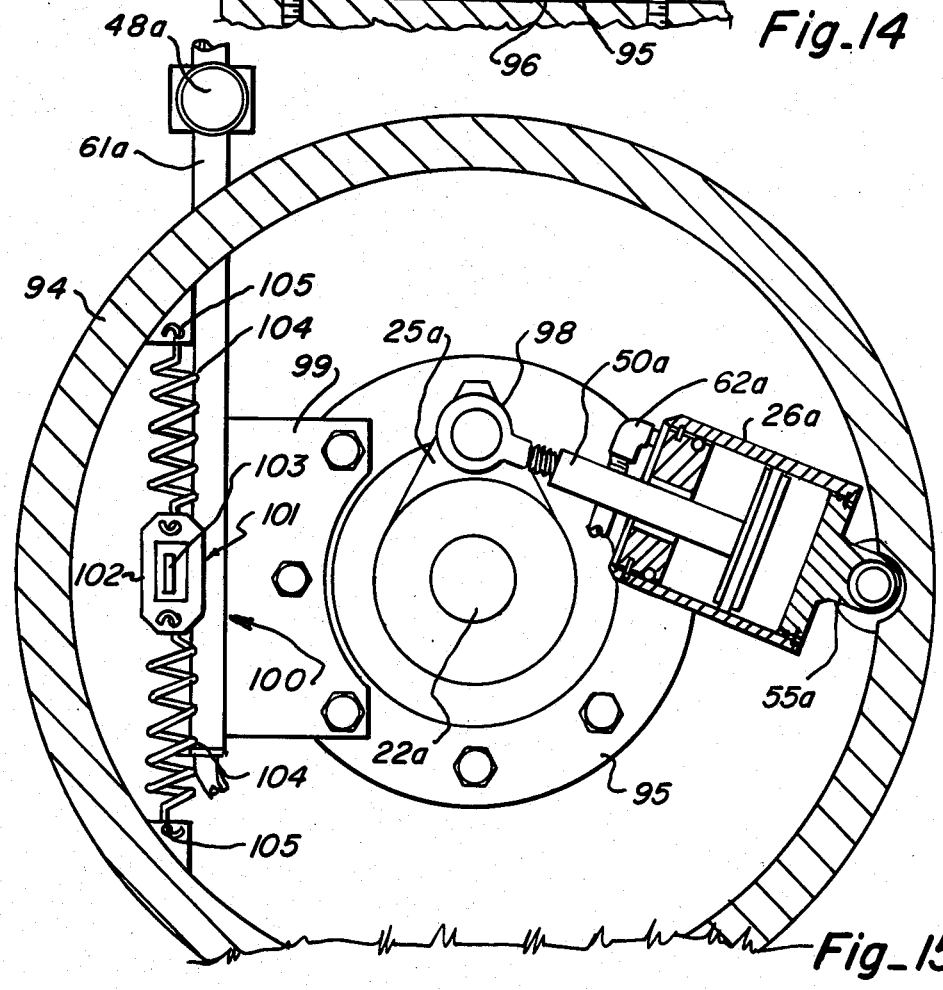
FIG. 15 is a section view taken substantially in plane of 15—15 on FIG. 14.

It may be observed that the reaction forces necessary to promote effective mixing of settled metallic paints, blended epoxy paints, fiber body fillers, and so forth in larger containers results in the necessity for securely bolting the housing 31 to a massive or rigid support. An alternative embodiment, as shown in FIGS. 14 and 15, employs a reaction countermass to eliminate the necessity of having to support the machine against primary reaction forces. Although the non-linear pneumatic spring characteristics and inherently good throttleability of the embodiment described above facilitate thorough mixing in small containers with minimum air use, the use of a countermass offers extra advantages in that the shake angle or total angle of motion for small containers is higher than that for large containers, a feature ideally suited to the mixing requirements of the containers. This occurs because the motion of the cylinder-motor assembly is split between the counterwheel and the load approximately in inverse proportion to their respective masses.

The motion splitting characteristics of the reaction wheel shaker shown in FIGS. 14 and 15 make the principles of this invention readily applicable to numerous applications where a vibratory force and/or mechanical oscillation of a quasi-sinusoidal nature is required, such as in many material handling or mixing requirements. To this end, a reaction mass such as a counterwheel allows this machine to drive loads which are very rigid, which have varying rigidity or inertia, or which have a highly frictional and only somewhat inertial character. In describing this modification of the present invention, reference characters similar to those used above will be employed where applicable, with the distinguishing suffix "a".

In the counterwheel modification, the main shaft 22*a* is extended downwardly and a flange base assembly 95 is provided with bearings 96 to support the main shaft 22*a* in a translationally rigid but rotationally free manner. A reaction counterwheel 94 forms the upper housing and dust shield for the machine, and is supported by bearings 97 on the main shaft 22*a* and crank arm 25*a*. Further, the counterwheel 94 mounts the head end bearing and journal assembly 55*a* for anchoring the cylinder-motor assembly 26*a*. The motor rod 50*a* is connected to the crank arm 25*a* by a rod end bearing assembly 98. A bracket 99 supports the inlet valve 48*a*, a short inlet pipe, and the air hose 61*a* which leads to the inlet fittg 62*a*. The bracket 99 also locates a centering spring subassembly 100, which consists of an elongated plate 101, having a central slot 102 slidably fitting over a bent tang end 103 of the bracket 99 and engaged at each end with extensions springs 104 whose outer ends are in turn attached to mounting bosses 105 on the rim of the counterwheel 94. The centering spring subassembly 100 locates the counterwheel 94 in its preferred average orientation with respect to the base assembly 95 to prevent pinching or stretching the air hose while allowing the counterwheel 94 to oscillate rotationally relative to about the rotating main shaft 22*a*.

The main shaft 22*a* is adapted to drive any number of objects or machines requiring a motor having the characteristics described. The rotational oscillations provided by this machine are readily converted to a linear force and/or mechanical oscillation by simply omitting the crank arm 25*a*, rod end assembly 98, and main shaft 22*a* and base 95, connecting the load directly to the cylinder assembly 98, and replacing the counterwheel 94 with a suitable countermass attached to the cylinder head. The motor may be driven by a compressed gas other than air, and may be used to mix, vibrate, or agitate substances other than paint.

This invention offers a substantial improvement over the state of the art in compressed gas-powered shaking and mixing machines. All of the thermodynamic advantages of the poppet type machine are retained, while adding easier starting, more speed and mixing power, better reliability, and only somewhat more complexity. Accelerated wear life testing of the preferred embodiment of this invention has proved it to be durable, reliable, and tolerant of abuse, while providing mixing power equal to the most expensive electric motor powered shakers and yielding excellent net air consumption efficiency. Furthermore, this invention provides a wide range of speed and power which enables containers ranging from a pint to a four-liter can, with liquid densities ranging from five to twelve or more pounds per gallon, to be shaken efficiently and thoroughly. Also, the principles of this invention are applicable to other material handling applications requiring a simple, reliable, efficient air-powered source of quasi-sinusodial vibration or motion.

While certain illustrative embodiments of the present invention have been shown in the drawings are described above in detail, it should be understood that there is no intention to limit the invention to the specific forms disclosed. On the contrary, it is the intention to cover all modifications, alternative constructions, equivalents and uses falling within the spirit and scope of the invention as expressed in the appended claims.

I claim:

1. In a paint shaker machine having a base housing mounting a double acting pneumatic piston and cylinder motor receiving compressed air from an air supply line for powering an inertial load comprising a shaker clamp mechanism holding a paint container, a cylinder pressure responsive bistable valve and a check valve in the air supply passage adjacent to the bistable valve for preventing reverse flow of air to said compressed air supply line, said valves controlling piston motion and providing an efficient pneumatic spring for reversing piston motion at a high accelration rate in said cylinder, the improvement comprising an elastomeric stud-centered cushioned cylinder head mount protruding visibly from the machine housing to isolate and reduce shock loads resulting from accidental bottoming out of the cylinder, and to provide a mechanical indicator which will safely and observably yield a signal when the machine is overloaded or oversped, which signal is observable by sight and feel to indicate overload and overspeed conditions.

2. A paint shaker comprising a base housing, a double acting pneumatic piston and cylinder motor, means mounting said piston and cylinder motor on said housing, said motor including a cylinder, a reciprocable piston in said cylinder having a piston rod slidably and sealably extending through one end wall of said cylinder, a clamp mechanism for holding a container to be shaken, a vertical shaft rotatably mounted on said housing, means mounting said clamp mechanism on said shaft for oscillation about a vertical axis, means including a crank arm operatively connecting said shaft to said piston rod, a disc type bistable control valve mounted transversely directly on the side of the air cylinder, said bistable valve having first and second outlet ports, a check valve adjacent said control valve, said cylinder defining a rod end cylinder inlet port in direct immediate communication with said first valve outlet port, said cylinder defining a head end inlet port in communication with said second outlet port, means in said control valve defining an inlet port for receiving compressed air through said check valve, a control disc for controlling the flow of air to said first and second outlet ports, and means defining a passage between said bistable control valve and said second outlet port whereby a higher cylinder pressure is developed in the rod end of said cylinder with respect to the pressure in the head end of said cylinder.

3. A paint shaker as defined in claim 2 wherein said bistable valve comprises a valve body, means in said body defining a disc valve cavity having opposed outlet ports defined by valve seats, a valve disc housed in said valve cavity and adapted to sealingly seat against one or the other of said valve seats to close the associated outlet port, means in said body defining an annular air feed cavity surrounding each of said valve seats, and means in said body defining passages for connecting said annular air feed cavities to a source of compressed air.

4. A paint shaker as defined in claim 3 wherein said source of compressed air includes an orifice and a relief valve downstream of the orifice for limiting gas pressure supplied to said piston and cylinder motor.

5. A paint shaker as defined in claim 4 wherein said source of compressed air further includes an air filter.

6. A paint shaker as defined in claim 2 wherein said piston and cylinder motor mounting means comprises a stud on said cylinder adapted to extended through an aperture in said housing wall, means for securing said stud to said wall and a pair of stiffly resilient stud mounted elastomeric pads intermediate said wall and said securing means.

7. A paint shaker as defined in claim 2, where said cylinder inlet ports are located at the lowest points in their respective cylinder ends, whereby said cylinder will tolerate relatively large quantities of liquid entrained in the supply air by allowing the liquid to be forced back into said inlet ports by the piston without hydraulically locking the piston, thereby increasing the useable compression ratio of the machine and enabling the machine to be operated with a higher thermodynamic efficiency.

8. A paint shaker as defined in claim 2, wherein said cylinder is generally horizontal, and including means mounting said bistable valve transversely and directly to the lower side of the cylinder such that said cylinder outlet ports are located at the lowest points in their respective cylinder ends.

9. A paint shaker as defined in claim 2 wherein clamp mechanism comprises an elongated inverted V-shaped channel, a pair of clamp jaws slidably supported on said channel, and means for moving said clamp jaws towards or away from each other for clamping or removing a container therebetween.

10. A paint shaker as defined in claim 9 wherein said jaw moving means comprises a double threaded screw, the threads on opposite ends of said screw being of opposite hand, said channel being superimposed over said screw for protecting the same.

11. A paint shaker comprising a base, a vertical shaft, means rotatably mounting said shaft on said base, a counterweight housing rotatably mounted on said shaft, means resiliently connecting said counterweight housing to said base, a double acting pneumatic piston and cylinder motor, means mounting said piston and cylinder motor on said counterweight housing, said motor including a cylinder housing a reciprocable piston having a piston rod slidably and sealably extending through one end wall of said cylinder, a clamp mechanism for holding a container to be shaken, means mounting said clamp mechanism on said shaft for oscillation about a vertical axis, means including a crank arm operatively connecting said shaft to said piston rod, a disc type bistable control valve mounted transversely directly on the side of said air cylinder, said bistable valve having first and second outlet ports, a check valve adjacent said control valve, said cylinder defining a rod end cylinder inlet port in direct communication with said first valve outlet port, said cylinder defining a head end inlet port in communication with said second valve outlet port, means in said control valve defining an inlet port for receiving compressed air from a source thereof through said check valve, a control disc for controlling the flow of air to said first and second outlet ports, and means defining a passage between said bistable disc valve and said second outlet port, whereby the force of said cylinder motor piston rod exerts an oscillating force against a body rigidly supported on said vertical shaft, and the reaction force of said cylinder motor exerts a relatively opposite oscillating force against the counterweight, resulting in a rotary oscillation of the counterweight with respect to the base.

12. A paint shaker as defined in claim 11 wherein said bistable control valve comprises a valve body, means in said body defining a disc valve cavity having opposed outlet ports defined by valve seats, said control disc being housed in said cavity and adapted to sealingly seat against one or the other of said valve seats to close the associated outlet port, means in said body defining an annular air feed cavity surrounding each of said valve seats, and means in said body defining passages for connecting said annular air feed cavities to a source of compressed air.

13. A paint shaker as defined in claim 12 wherein said source of compressed air includes a filter and a relief valve.

14. A paint shaker as defined in claim 11, where said cylinder inlet ports are located at the lowest points in their respective cylinder ends, whereby said cylinder will tolerate relatively large quantities of liquid entrained in the supply air by allowing said liquid to be forced back into said inlet ports by the piston without hydraulically locking the piston, thereby increasing the useable compression ratio of the machine and enabling the machine to be operated with a higher thermodynamic efficiency.

15. A paint shaker as defined in claim 11 wherein said cylinder is generally horizontal, and including means mounting said bistable valve transversely and directly onto the lower side of the cylinder such that said cylinder outlet ports are located at the lowest points in their respective cylinder ends.

16. A paint shaker as defined in claim 11 wherein said resilient connecting means between said counterweight housing and said base comprises a pair of relatively low spring rate springs, thereby providing a shaker capable of high rotational acceleration rates and high frequencies while isolating the machine base from the primary shaker force produced by said motor.

17. A paint shaker as defined in claim 11 wherein said piston and cylinder motor mounting means comprises a stud on said cylinder adapted to extended through an aperture in said housing wall, means for securing said stud to said wall and a pair of stiffly resilient stud mounted elastomeric pads intermediate said wall and said securing means.

18. A paint shaker as defined in claim 11 wherein said source of compressed air includes an orifice and a relief valve downstream of the orifice for limiting gas pressure supplied to said piston and cylinder motor.

19. A paint shaker as defined in claim 11 wherein said clamp mechanism comprises an elongated inverted V-shaped channel, a pair of clamp jaws slidably supported on said channel, and a means for moving said clamp jaws towards or away from each other for clamping or removing a container therebetween.

20. A paint shaker as defined in claim 19 wherein said jaw moving means comprises a double threaded screw, the threads on opposite ends of said screw being of opposite hand, said channel being superimposed over said screw for protecting the same.

21. A paint shaker comprising a base housing, a double acting pneumatic piston and cylinder motor, means mounting said piston and cylinder motor on said housing, said motor including a cylinder housing a reciprocable piston having a piston rod slidably and sealably extending through one end wall of said cylinder, a clamp mechanism for holding a container to be shaken, a vertical shaft for oscillation about a vertical axis, means including a crank arm operatively connecting said shaft to said piston rod, a disc type bistable control valve mounted transversely directly on the side of the air cylinder, said bistable valve having first and second outlet ports, said cylinder defining a rod end cylinder inlet port in direct immediate communication with said first valve outlet port, said cylinder defining a head end inlet port in communication with said second outlet port, means in said control valve defining an inlet port for receiving compressed air, a control disc for controlling the flow of air to said first and second outlet ports, means defining a passage connecting said inlet port to said control disc, a check valve in same passage, a filter in said inlet port, a relief valve communication with same passage, and means defining a passage between said bistable control valve and said second outlet port whereby a higher cylinder pressure is developed in the rod end of said cylinder with respect to the pressure in the head end of said cylinder.

22. A paint shaker as defined in claim 21, wherein said cylinder inlet ports are located at the lowest points in their respective cylinder ends, whereby said cylinder will tolerate relatively large quantities of liquid entrained in the supply air by allowing the liquid to be forced back into said inlet ports by the piston without hydraulically locking the piston, thereby increasing the useable compression ratio of the machine and enabling the machine to be operated with a higher thermodynamic efficiency.

23. A paint shaker comprising a base housing, a double acting pneumatic piston and cylinder motor, means mounting said piston and cylinder motor generally horizontally on said housing, said motor including a cylinder housing a reciprocable piston having a piston rod slidably and sealably extending through one end wall of said cylinder, a clamp mechanism for holding a container to be shaken, a vertical shaft rotatably mounted on said housing, means mounting said clamp mechanism on said shaft for oscillation about a vertical axis, means including a crank arm operatively connecting said shaft to said piston rod, a disc type bistable control valve, means mounting said valve transversely directly on the lower side of said cylinder, said bistably valve comprising a valve body, means in said body defining first and second outlet ports, means in said body defining a disc valve cavity having opposed outlet ports defined by valve seats and communicating respectively with said just and second outlet ports, a valve disc housed in said valve cavity and adapted to sealingly seat against one or the other of said valve seats to close the associated outlet port, means in said body defining an annular air feed cavity surrounding each of said valve seats, means in said body defining an inlet port adapted to be connected to a source of compressed air, means defining a passage connecting said inlet port to said annular air feed cavities, a check valve in said passage, an air filter in said inlet port, a relief valve communicating with said passage, said cylinder defining a rod end cylinder inlet port in direct immediate communication with said first valve outlet port, said cylinder defining a head end inlet port in communication with said second outlet port, means defining a passage between said bistable disc valve and said second outlet port whereby a higher cylinder pressure is achieved in the rod end of said cylinder with respect to head end cylinder pressure, said cylinder inlet ports being located at the lowest points in their respective cylinder ends whereby said cylinder will tolerate relatively large quantities of liquid entrained in the supply air by allowing the liquid to be forced back into said inlet ports by the piston without hydraulically locking the piston, thereby increasing the useable compression ratio of the machine and enabling the machine to be operated with a higher thermodynamic efficiency.

24. In a double acting penumatic piston and cylinder motor driving an inertial load in response to a supply of compressed air from a main air supply passage said motor comprising a cylinder having side and end walls and a piston slidably mounted within said cylinder, and branch air supply passages for supplying compressed air to said motor alternatley on opposie sides of said piston for driving the same, and an exhaust port in said cylinder wall intermediate said branch air supply passages, the improvement comprising a cylinder pressure responsive bistable valve in said main air supply passage for directing compressed air alternately to one or the other of said branch air supply passages and thereby alternately to opposite sides of said piston, and a check valve in said main air supply passage adjacent to said bistable valve for preventing reverse flow of air to said compressed air supply when said piston approaches an end of said cylinder and compresses the air therein, said valves controlling piston motion and providing an efficient pneumatic spring for reversing piston motion at a hgih acceleration rate in said cylinder and for preventing contact of said piston with said cylinder end walls.

25. A double acting pneumatic piston and cylinder motor as defined in claim 24, wherein said inertial load is a paint container holder and a paint container therein.

26. A double acting pneumatic piston and cylinder motor as defined in claim 24, wherein said bistable valve is a disk valve.

27. A double acting pneumatic piston and cylinder motor as defined in claim 24, wherein said check valve is a disk valve.

28. In a paint shaver machine having a base housing mounting a double acting pneumatic piston and cylinder motor for powering a shaker clamp mechanism holding a paint container, said piston and cylinder motor comprising a cylinder having side and end walls and a piston slidably mounted with in said cylinder, a main air supply passage for supplying compressed air to said cylinder, and branch air supply passages for supplying compressed air from said main air supply passage to said motor alternately on opposite sides of said piston for driving the same, and an exhaust port in said cylinder wall intermediate said branch air supply passages, the improvement comprising a cylinder pressure responsive bistable valve in said main air supply passage for directing compressed air alternately to opposite sides of said piston, through one or the other of said branch air passages and a check valve in said main air supply passage adjacent to said bistable valve for preventing reverse flow of air to said compressed air supply when said piston approaches an end of said cylinder and compresses the air therein, said valves controlling piston motion and providing an efficient pneumatic spring for reversing piston motion at a high acceleration rate in said cylinder and for preventing contact of said piston with said cylinder end walls.

* * * * *